US006527465B1

(12) United States Patent
Welch

(10) Patent No.: US 6,527,465 B1
(45) Date of Patent: Mar. 4, 2003

(54) RING BINDER ASSEMBLY

(76) Inventor: Stephen R. Welch, 1085 Flamingo Dr., Roselle, IL (US) 60172

( * ) Notice: Subject to any disclaimer, the term of this patent is extended or adjusted under 35 U.S.C. 154(b) by 0 days.

(21) Appl. No.: 09/675,602

(22) Filed: Sep. 29, 2000

(51) Int. Cl.[7] ..... B42F 13/00

(52) U.S. Cl. ..... 402/26; 402/31; 402/36; 402/46; 281/21.1

(58) Field of Search ..... 402/26, 31, 36–42, 402/80 L, 80 P; 283/15.1, 21.1, 29, 36, 45

(56) References Cited

U.S. PATENT DOCUMENTS 1,818,999 A * 8/1931 Murphy ..... 402/80 L
1,977,897 A * 10/1934 Schlossen et al. ..... 402/80 L
3,191,604 A * 6/1965 Wance ..... 402/80 L

* cited by examiner

*Primary Examiner*—William Fridie, Jr.

(57) ABSTRACT

A ring binder assembly is disclosed as including a ring mechanism, a connecting means secured to the ring mechanism, and at least one removable module frictionally engaging the connecting means. The connecting means is configured to receive the removable modules, wherein when the modules are removed the connecting means is maintained in a substantially tight configuration. The connecting means typically includes a rivet passing through an eyelet in the ring mechanism. In addition, the means to connect may also include the means to resilient secure the removable modules in place. The resilient means may include a compression spring housed in the eyelet biasing an upper washer downwardly towards the rivet.

13 Claims, 9 Drawing Sheets

Figure 8a
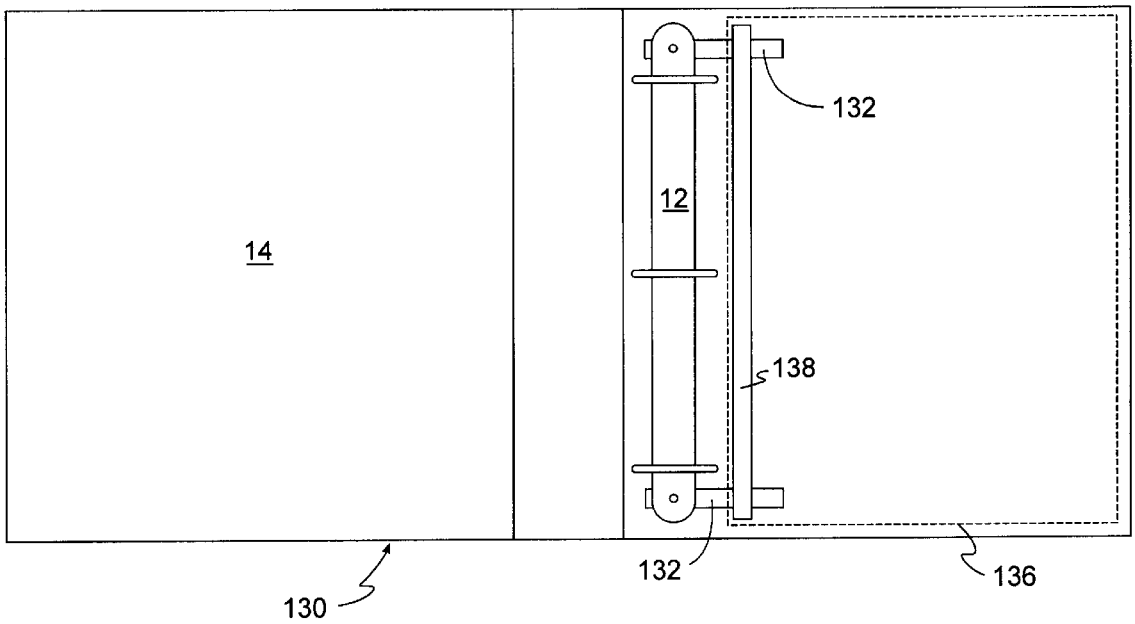
Figure 8b
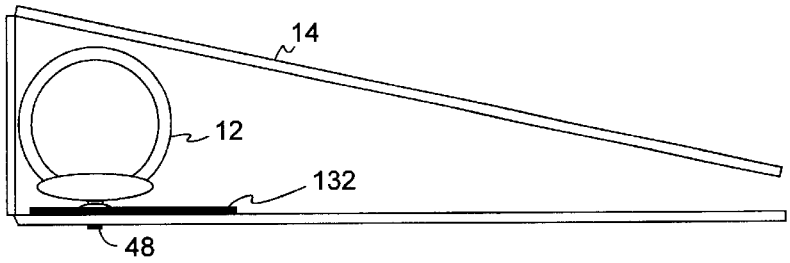
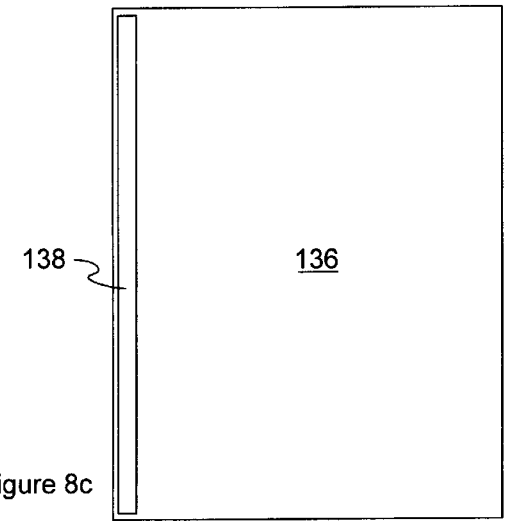
Figure 8c

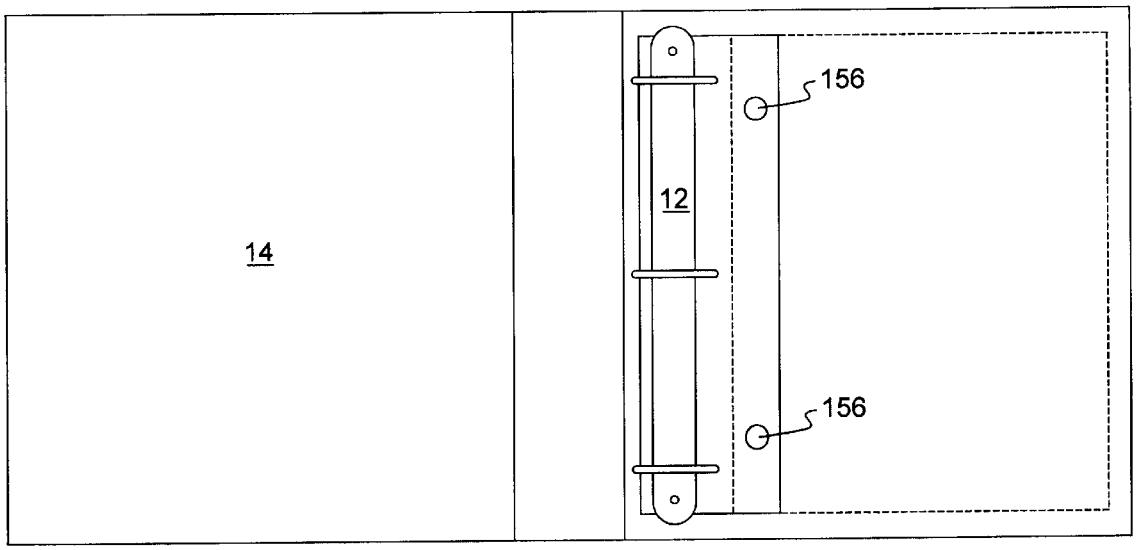
Figure 9a
Figure 9b
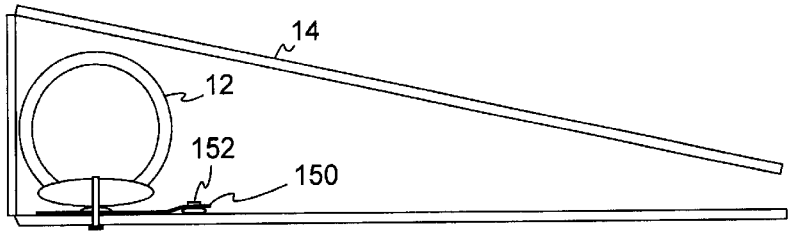
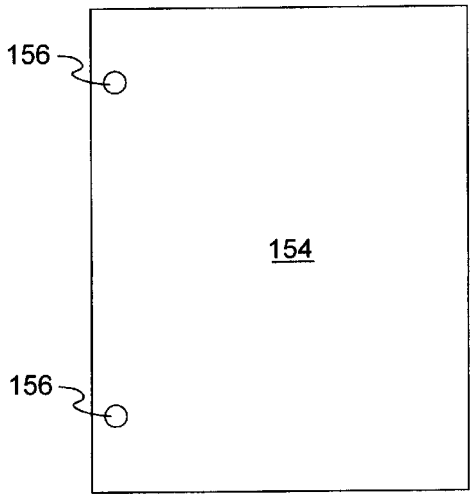
Figure 9c

RING BINDER ASSEMBLY

FIELD OF THE INVENTION

This invention relates to ring binders, and more particularly to a ring binder assembly that includes a means to connect modules to the assembly and in addition to resiliently secure the modules in place.

BACKGROUND OF THE INVENTION

A typical ring binder assembly includes a ring mechanism attached to a cover by a rivet or other securing means well known in the art (hereinafter referred to as "assembly"). In most assemblies, the ability to attach and store materials thereto is limited to attaching the materials onto the rings by various modules or in the pockets provided in the inside covers. These modules permit the user to secure various office, home and/or school supplies to the binders. However, because these modules attach to the rings of the binders the ring capacity is used, limiting the amount of paper or other items that could be attached to the rings.

It is therefore an object of the present invention to provide a ring binder assembly that allows various removable modules to be attached and secured to this assembly, which does not utilize the ring capacity. While it may be contemplated to provide longer rivets to allow the modules to be attached thereto. The longer rivets tend to be loose and rattle, which may cause the rivets to catch or snag on something, thereby breaking the rivet or binder. It is therefore also an object of the present invention to provide a means to maintain the rivets and ring binder assembly in a substantially tight configuration, such that when the modules are secured or removed from the binder, the binder or rivets do not rattle.

SUMMARY OF THE INVENTION

In accordance with the present invention, there is provided a ring binder assembly that includes a spool-shaped washer positioned between the ring mechanism and the cover. If the ring mechanism includes eyelets, the washer may be integrally formed into the eyelet or provided as an independent piece. The modules may then be attached and removed from the mid-section of the spool-shaped washer. The spool-shaped washer provides adequate space for the modules and maintains the rivets and the ring binder assembly in a tight configuration, such that the rivets are not loose when the modules are removed or attached.

In another embodiment, each eyelet has a compression spring and a cone washer attached to the bottom of the eyelet. The compression spring biases the cone washer downwardly towards the rivet head maintaining the rivet in a substantially tight configuration and resiliently holding the modules in place. In this configuration, the modules attach directly to the rivets. Additional cone washers may be used to maintain adequate spacing between the cover, the modules and the eyelets.

Additionally, a telescoping eyelet may be incorporated. The telescoping eyelet includes an inner sleeve and an outer sleeve with a compression spring biasing the two sleeves away from each other. To prevent the sleeves from separating, the inner sleeve has an outwardly tapered edge and the outer sleeve has an indentation around the edge. When biased away from each other, the tapered edge and inside of the indentation engage each other preventing the two sleeves from separating. Moreover, the inner sleeve may also include a cone head integrally formed thereon.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 8*a* is another embodiment of the present invention illustrating a top view of a ring binder assembly with a two piece module that attaches between the ring mechanism and the cover by VELCRO® or other similar securing means;

FIG. 8*b* is a side view of FIG. 8*a*, prior to attaching the second piece of the module;

FIG. 8*c* is a top view of the second piece of the module in accordance with FIG. 8*a;*

FIG. 9*a* is another embodiment of the present invention illustrating a top view of a ring binder assembly with a two-piece module that attaches between the ring mechanism and the cover by snaps or other similar securing means;

FIG. 9*b* is a side view of FIG. 9*a*, prior to attaching the second piece of the module; and FIG. 9*c* is a top view of the second piece of the module in accordance with FIG. 9*a*.

DETAILED DESCRIPTION OF THE DRAWINGS

Figure 1A:
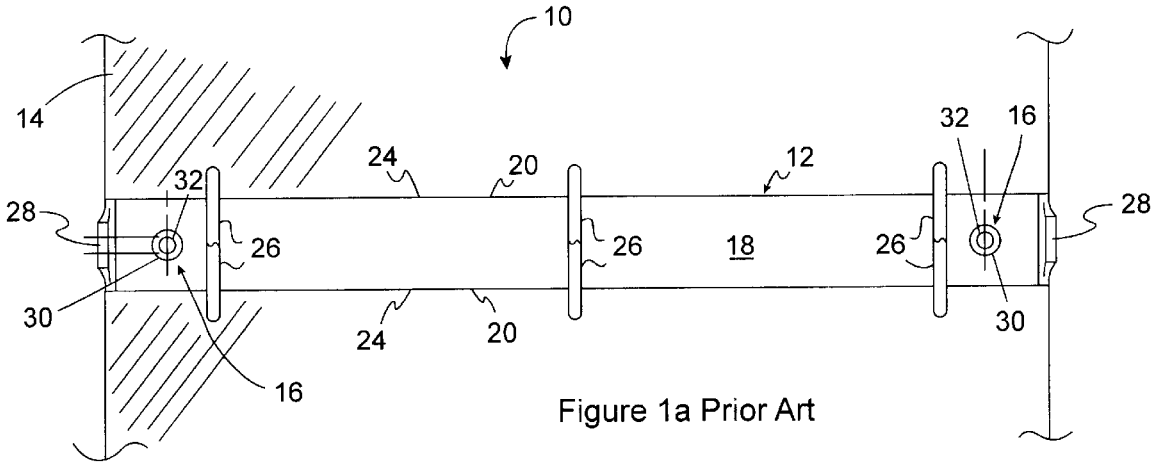
Figure 1a Prior Art
FIG. 1*a* is a top view of a ring binder assembly in accordance with the prior art.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 1B:
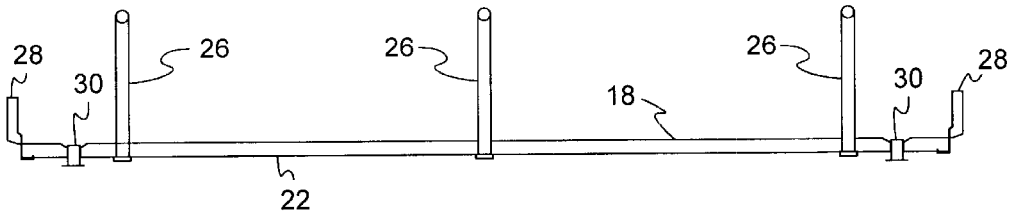
Figure 1b Prior Art
FIG. 1*b* is a side view of the ring binder assembly from FIG. 1*a;*
Figure 1C:
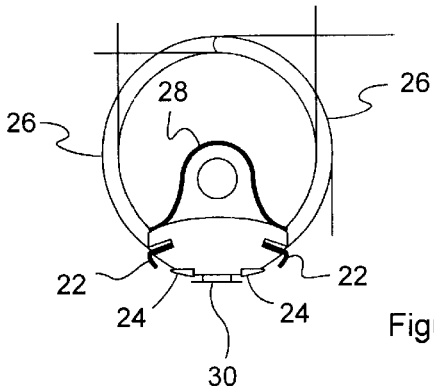
Figure 1c Prior Art
FIG. 1*c* is a rear view of the ring binder assembly from FIG. 1*a;*

Referring to FIGS. 1*a*–1*c*, a conventional ring binder assembly generally designated as 10 typically comprises a ring mechanism 12 connected to a cover 14 by a connecting means 16. Typically, the ring mechanism 12 includes a convex upper plate 18 having lateral edges 20 that are bent inward to form longitudinal seats 22, which support a pair of pivotable lower plates 24. Three rings 26, each formed in two halves are typically mounted into the pivotable lower plates 24. The ring mechanism 12 also includes a pair of actuating levers 28 that are attached to the ends of the ring mechanism 12, in a manner well known in the art, such that when the actuating levers 28 are pivoted outwardly, the lower plates 24 pivot such that the ring halves 26 open. The connecting means 16 typically includes a pair of eyelets 30 secured through the ring mechanism 12 at each end, separately. Each eyelet 30 receives a rivet 32, which also passes through the cover 14, thereby securing the cover 14 to the ring mechanism 12, forming the ring binder assembly 10. It should be noted, that various other conventional ring mechanisms, such as those that incorporate more or less rings, ring mechanisms without actuating levers or ring mechanism without eyelets, may be employed herein without deviating from the spirit or scope of the invention.

Figure 2A:
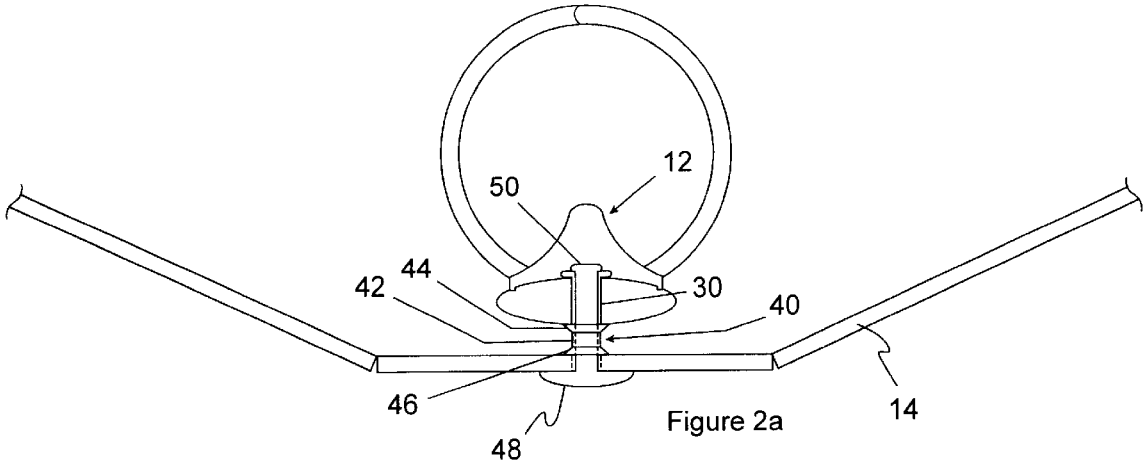
FIG. 2*a* is an enlarged side view of the eyelet and spool-shaped washer in accordance with the present invention.
Figure 2B:
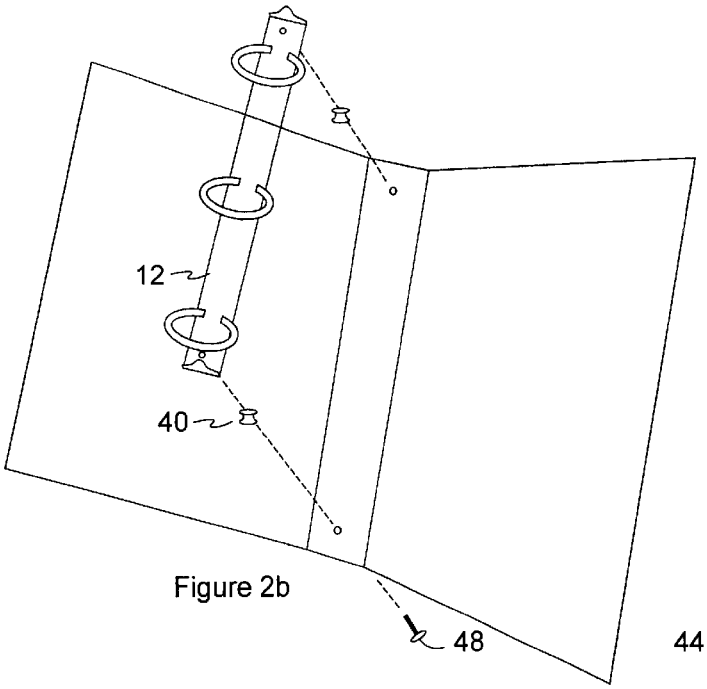
FIG. 2*b* is an exploded view of a ring binder assembly with a washer in accordance with the present invention.

Referring now to FIGS. 2*a* and 2*b* and in accordance with the present invention a means for connecting modules between the ring mechanism and the cover is shown. More specifically, a washer 40 is provided between the ring mechanism 12 and the cover 14. As stated above, in some ring binder assemblies the ring mechanism 12 includes an eyelet 30. The washer 40 may in these types of assemblies be positioned between the eyelet 30 and the cover 14, FIG. 2*d*. The rivet 48 secures the ring mechanism 12 to the cover 14. Continuing to refer to FIG. 2*a*, once the rivet 48 is passed through the washer 40 and the eyelet 30, the tail 50 of the rivet 48 is curled to engage the eyelet 30, holding the rivet 48 in a substantially tight configuration with the ring mechanism 12, such that the rivets tend not to rattle.

Figure 2C:
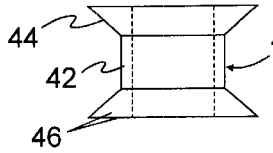
FIG. 2*c* is a side view of the washer from FIG. 2*a;*
Figure 2D:
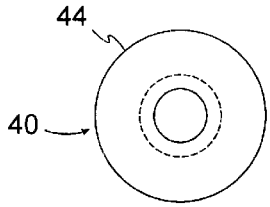
FIG. 2*d* is a top view of the washer from FIG. 2*c;*

Referring now to FIGS. 2*c* and 2*d*, the washer 40 is preferably spool-shaped and includes a cylindrical mid-section 42, and cylindrical upper and lower portions, 44 and 46 respectively. The cylindrical mid-section 42 has a reduced diameter in relation to the larger diameters of the cylindrical upper portion 44 and lower portion 46. However, the washer 40 may be a single diameter.

Figure 3A:
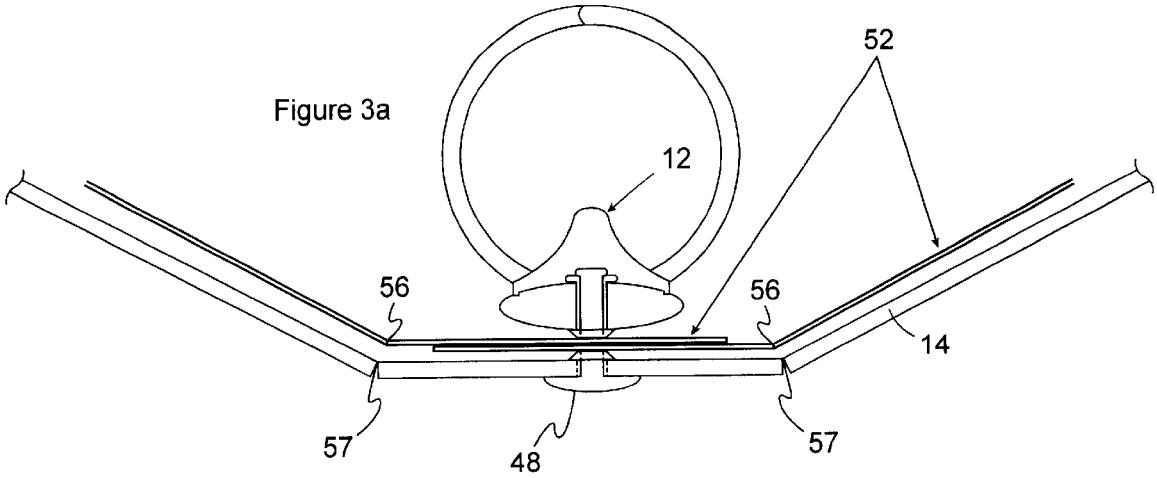
FIG. 3*a* is a side view of FIG. 2*a* with modules attached thereto.
Figure 3B:
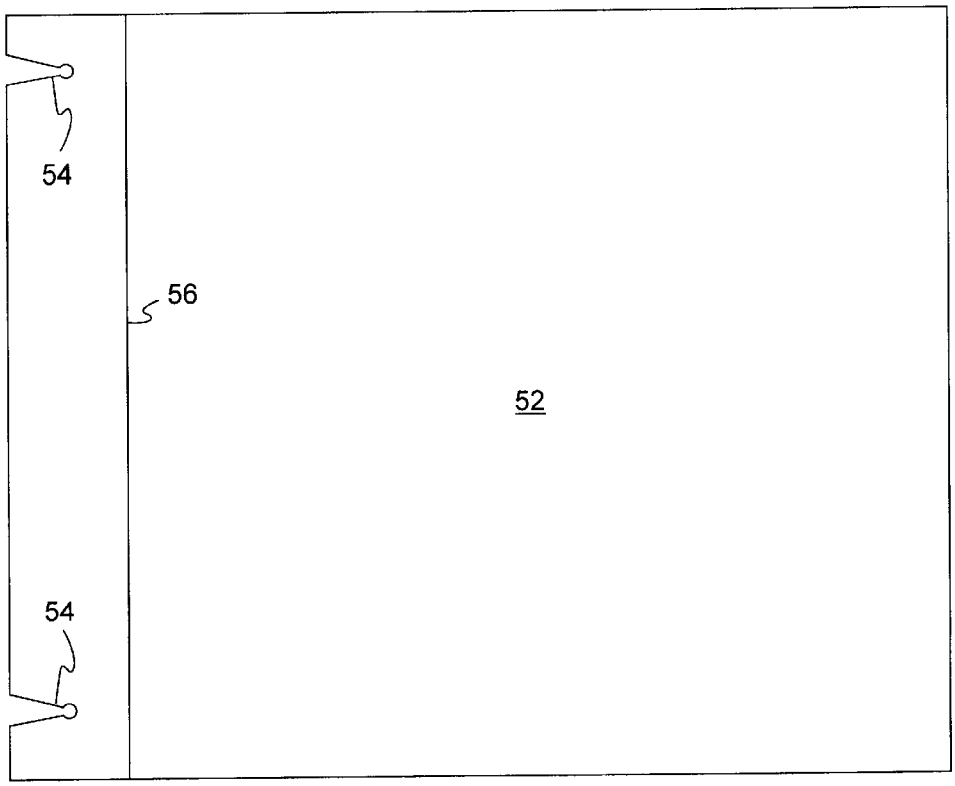
FIG. 3*b* is a top view of a module.

When the binder is assembled in accordance with the present invention, as illustrated in FIG. 2*a*, modules 52 may be inserted between the ring mechanism 12 and the cover 14, shown in FIG. 3*a*. The modules 52 as depicted in FIG. 3*b* include a groove 54 sized to frictionally engage the mid-section 42 of the washer 40. This permits the modules 52 to be removed and replaced with other modules without disassembling the binder 10. Since the modules 52 attach to the washer 40 the rivets 48 and the ring mechanism 12 may always remain in a tight configuration, thus overcoming. the shortcomings mentioned above.

The modules 52 may include numerous different configurations and designs. For example, the modules may include different designs or colors that are read or seen through a transparent cover. The modules may also have various sized or shaped pockets or holders that secure various items such as paper, CD-ROMs, floppy disks, VHS tapes, other office supplies and items. Each module 52 preferably has a scored edge 56 that aligns with the perforation 57 in the cover 14, such that when the binder is closed the module 52 rests against the cover 14, illustrated in greater detail below.

Figure 4A:
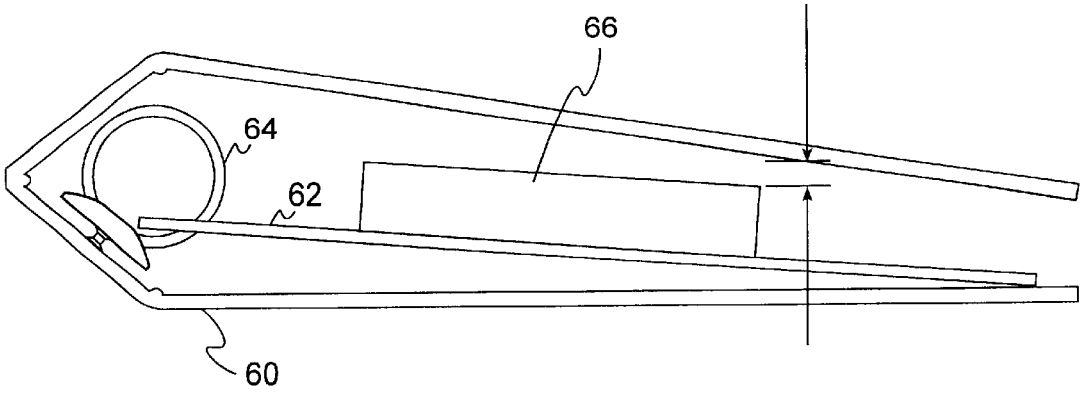
FIG. 4*a* is a cross-sectional view of a module conventionally attached to a ring mechanism utilizing ring capacity.
Figure 4B:
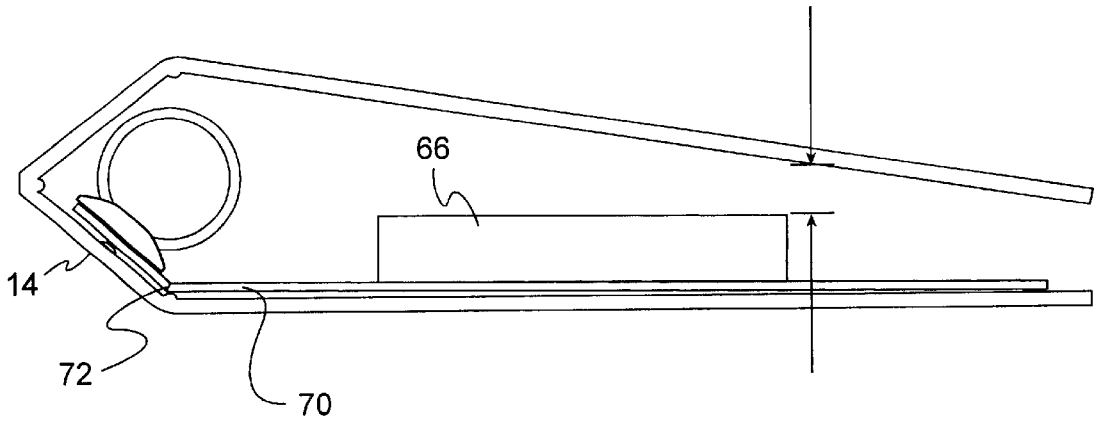
FIG. 4*b* is a cross-sectional view of a module attached between the ring mechanism and the cover in accordance with the present invention.

Since the modules 52 are attached between the ring mechanisms and the covers no ring capacity is used and the binder space is more properly utilized. As illustrated in FIG. 4*a* a typically module 62 is attached through the rings 64 of a binder 60. The module 62 is designed to hold a VHS tape 66. As illustrated the module 62 utilizes a portion of the ring capacity that when the binder 60 is closed causes the VHS tape 66 to take up a majority of the binder space. However, as illustrated in FIG. 4*b*, a module 70 as described above with a perforated edge 72 and capable of holding a VHS tape 66, attaches between the ring mechanism 12 and the cover 14. As illustrated the module 70 does not utilize any ring capacity. Moreover, when the binder is closed, the module 70 rests against the cover 14 leaving the binder space open.

Figure 5A:
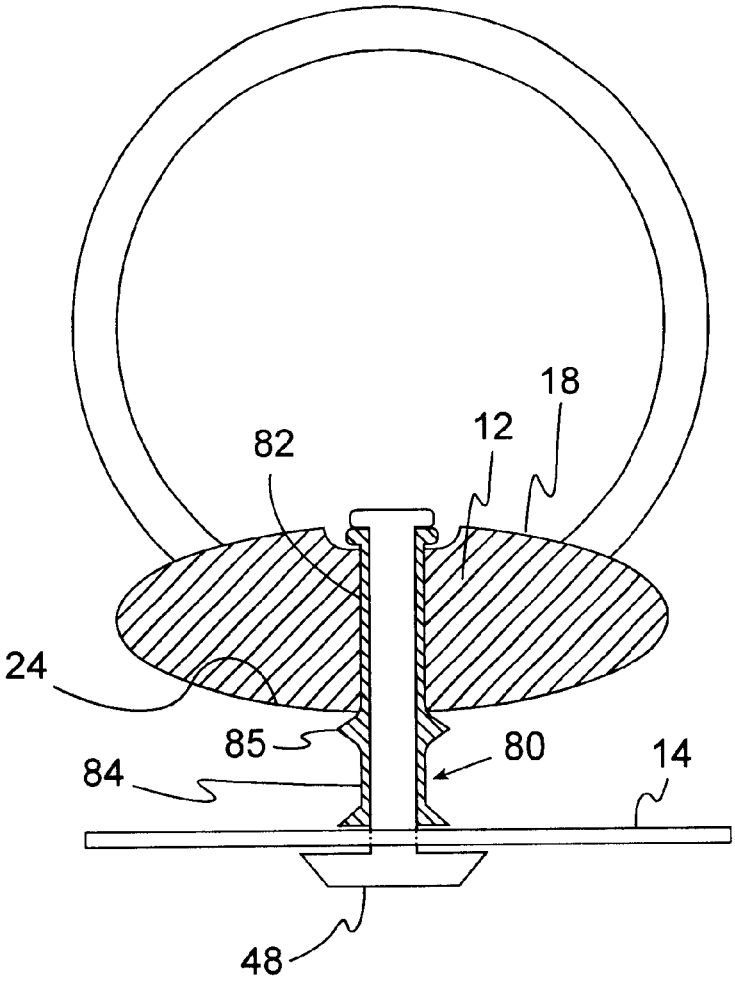
FIG. 5*a* is a cross-sectional view of a eyelet and washer integrally formed in a one piece construction.
Figure 5B:
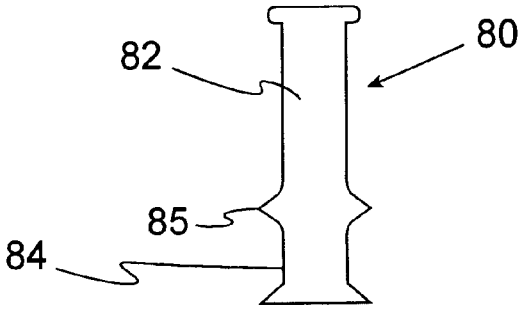
FIG. 5*b* is a cross-sectional view of the integrally formed eyelet/washer from FIG. 5*a;*

Referring now to FIGS. 5*a* and 5*b*, in another embodiment of the present invention an eyelet may be integrally molded with a spool-shaped washer, generally referenced as 80. The eyelet/washer has a top portion 82 and a bottom portion 84 and is sized to receive a rivet 48. The bottom portion 84 of the eyelet/washer 80 includes a spool-shaped washer that is sized to receive the modules as discussed above. The eyelet/washer 80 may also include protrusions 85 integrally molded into the eyelet/washer 80 that serve to separate the bottom portion 84 and the top portion 82. When the eyelet/washer 80 is inserted through the ring mechanism 12 the top portion 82 is curled over the upper plate 18 and the protrusions 85 rest below the pivotable lower plates 24, securing the eyelet/washer 80 in place. The inclusion of the protrusions 85 prevents the eyelet/washer 80 from sliding upwardly and downwardly within the ring mechanism 12. It is important to note that while preferably the eyelet/washer 80 includes the protrusions 85, other embodiments of the present invention may provide for an eyelet/washer that does not include such protrusions 85.

It should also be noted that various other binders do not utilize eyelets. In such instances the ring mechanism attaches to the cover by crimping a rivet through the two. As such, the washer may be placed directly against the ring mechanism. The rivet would then pass through the cover, washer and the ring mechanism without using an eyelet.

Figure 6A:
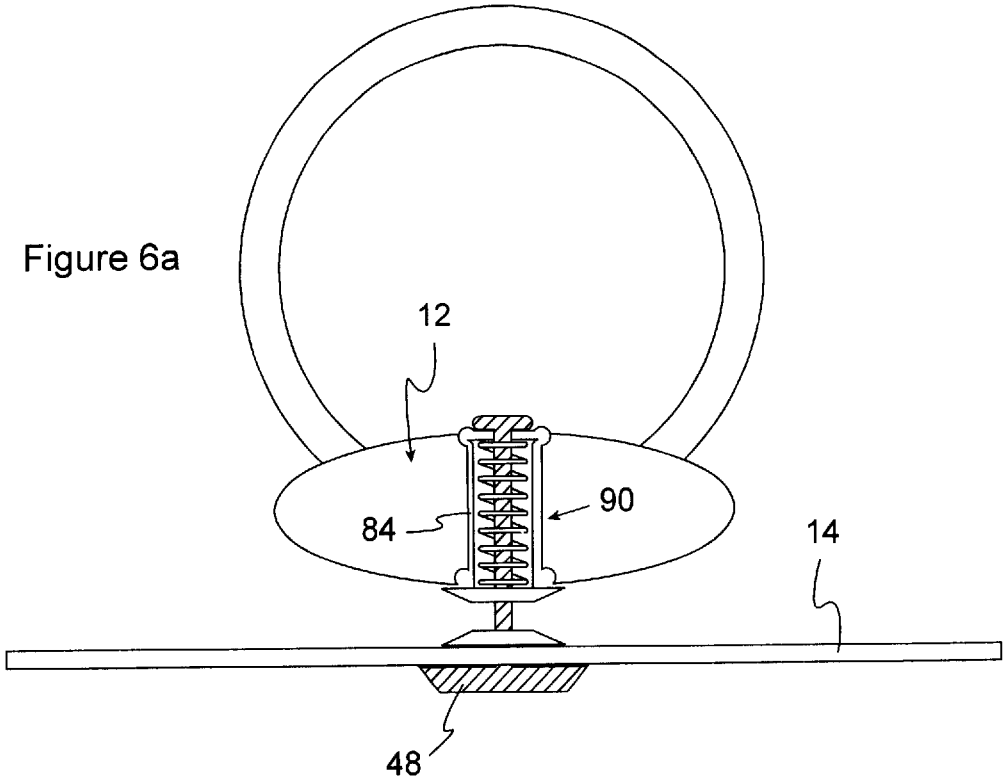
FIG. 6*a* is a cross-sectional view of a telescoping eyelet in accordance with the present invention.
Figure 6B:
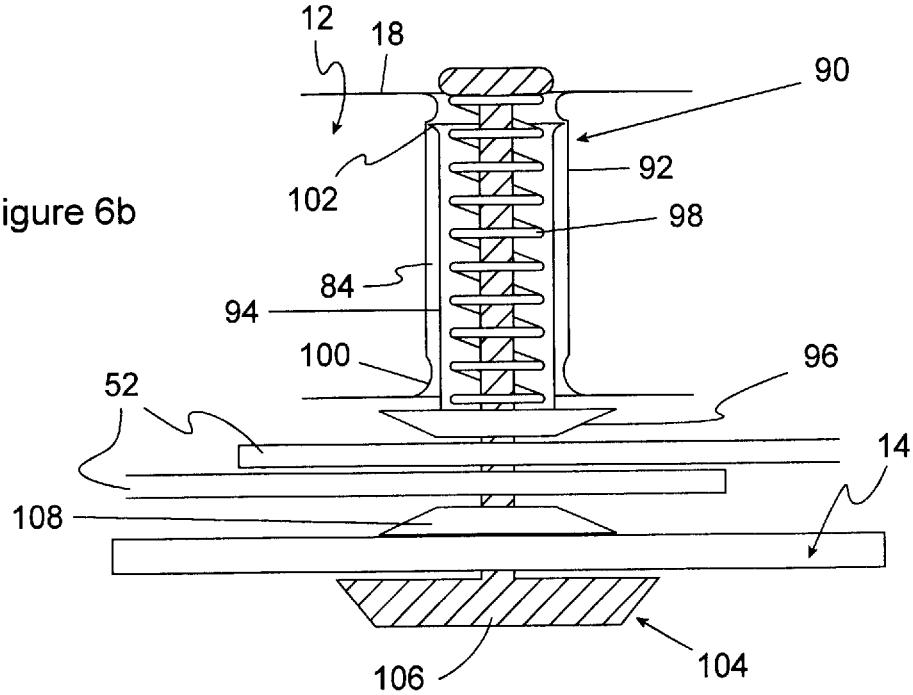
FIG. 6*b* is a cross-sectional view of a telescoping eyelet attached to a ring mechanism with modules interconnected to the rivet.
Figure 6C:
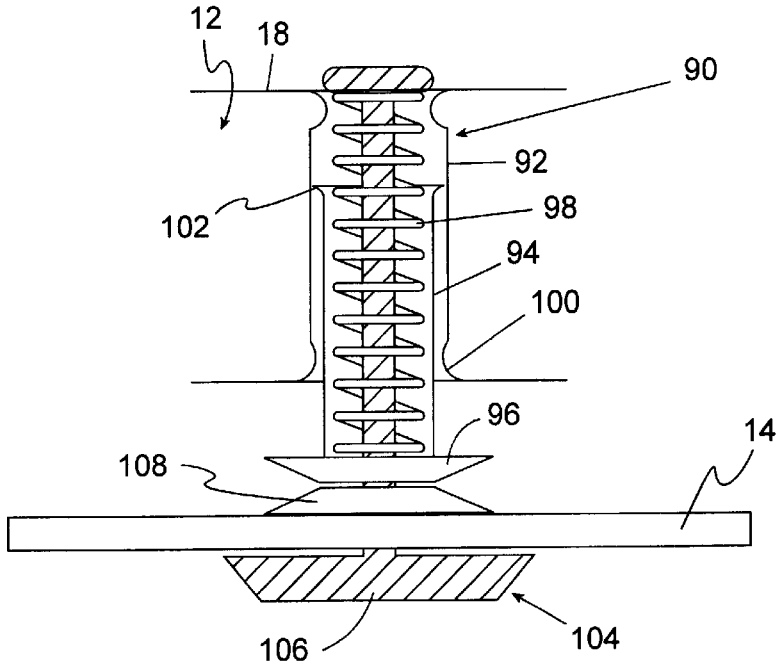
FIG. 6*c* is a cross-sectional view of the telescoping eyelet when the modules are removed or prior to inserting the modules.

In yet another embodiment of the present invention, as illustrated in FIGS. 6*a*, 6*b* and 6*c*, a means to resilient secure the modules 52 under a ring mechanism 12 is generally illustrated as 84. The resilient securing means 84 is preferably a telescoping spring-loaded eyelet 90, which includes an outer sleeve 92 that is attached or secured to the upper plate 18 of a ring mechanism 12. The telescoping eyelet 90 also includes an inner sleeve 94 that has a cone head 96 integrally formed thereon. A compression spring 98 is positioned within the two sleeves and biases the two sleeves away from each other. To prevent the two sleeves from separating, the outer sleeve 92 includes an indentation 100 around its lower portion and the inner sleeve 94 includes an outwardly tapered edge 102 around its top portion. When biased away from each other, the indentation 100 engages the tapered edge 102 preventing the sleeves from separating. When a rivet 104 is passed through the telescoping eyelet 90 and secured to the ring mechanism 12, the compression spring 98 maintains the cone head 96 downwardly towards the rivet head 106. Various modules 52 may be attached onto the rivet 104 between the cone head 96 and the rivet head 106, or between the cone head 96 and an independent cone washer 108. When the modules 52 are removed, FIG. 6*c*, the compression spring 98 biases the inner sleeve 94 downwardly against the cone washer 108, thus maintaining the rivet 104 in a substantially tight configuration.

Figure 7:
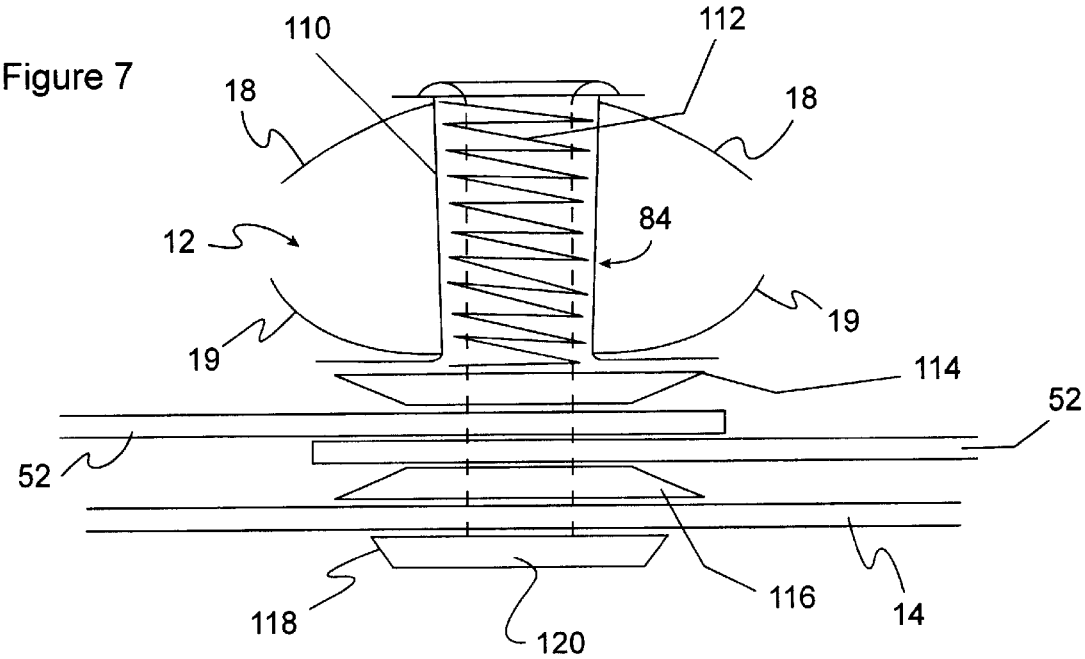
FIG. 7 is a cross-sectional view of the spring loaded eyelet attached.

In yet another embodiment of the present invention and as illustrated in FIG. 7, the resilient securing means 84 includes a spring-loaded eyelet 110 positioned between the ring mechanism 12 and the cover 14. As mentioned above the eyelet 110 is secured through the lower and upper plates 19 and 18 respectively, of the ring mechanism 12. The spring-loaded eyelet 110 includes a compression spring 112 that biases an upper cone washer 114 downwardly towards a lower cone washer 116. A rivet 118, similarly described above, secures the ring mechanism 12 with the spring-loaded eyelet 110 and the upper and lower cone washers 114 and 116 to the cover 14. Various modules 52 frictionally engage the rivet 118 between the upper cone washer 114 and the lower cone washer 116. Since the spring 112 biases the upper cone washer 114 downwardly against the rivet head 120, the modules 52 are resiliently held in position. Moreover, the rivet 118 is held in position thereby restricting movement or rattling of the rivet 118 when modules 52 are in place or removed. In various other embodiments, the lower cone washer 116 may be removed without materially affecting the scope of the invention.

In yet another embodiment of the present invention, other means for connecting modules between the ring mechanism and the cover is illustrated and described below with reference to FIGS. 8*a*–8*c* and 9*a*–9*c*. While the modules illustrated and described in the previous embodiments are unitary or single piece modules that click into the ring mechanism assembly, the modules may consist of a multi-piece arrangement. Referring to FIGS. 8*a*–8*c*, a ring binder assembly 130 includes a ring mechanism 12 and a cover 14 secured to each other by rivets 48. The connecting means may include a pair of straps 132, which is permanently or removably attached to the assembly between the ring mechanism 12 and the cover 14. Each strap 132 would be made of or include a portion of VELCRO® or other similar type of securing material or means. A module 136, which included a second strip 138 or portion configured to receive or attach to the first portion 134, would then removably connect to the straps 132. The module 136 may be designed to hold or secure various types of supplies.

Referring now to FIGS. 9*a*–9*c*, the connecting means may include a two-piece module with snaps. A first section 152 is attached to the assembly between the ring mechanism 12 and the cover 14. The first section 152 would also include one portion of the snaps, for instance the female portion 152. The second section 154 would then include the other or male 156 portion of the snaps. The second section 154 would also include the various pocket or holders. Since the second section 154 is removable, various different modules could be attached to the assembly by utilizing the snaps.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A ring binder assembly comprising: a ring mechanism; a cover; a means to connect at least one removable module between the ring mechanism and the cover; and a means to secure together the ring mechanism, the connecting means and the cover; and a pair of eyelets secured through the ring mechanism, the pair of eyelets configured to receive the securing means and positioned against the connecting means, wherein the connecting means comprises a washer having a mid-section sized to frictionally receive the at least one module.

2. The ring binder assembly of claim 1, wherein the washer is spool-shaped.

3. The ring binder assembly of claim 2, wherein the securing means comprises a pair of rivets separately secured in a substantially tight configuration through one of the washers and its corresponding eyelet.

4. The ring binder assembly of claim 1 wherein the securing means further includes the means to resiliently secure the ring mechanism, the connecting means and the cover together, when at least one removable module is connected to or removed from the connecting means.

5. The ring binder assembly of claim 1 wherein the securing means and the connecting means comprises at least one rivet, each rivet having a rivet head and passes through the cover and the ring mechanism and wherein at least one removable module may connect to the rivet between the rivet head and the ring mechanism.

6. The ring binder assembly of claim 4 wherein the resilient securing means comprises:

a pair of eyelets secured through the ring mechanism;

an upper cone washer positioned against each eyelet;

a compression spring housed in each eyelet and biasing the upper cone washer towards the rivet head such that the modules are resiliently secured relative to the rivet between the upper cone washer and the rivet head and wherein when the modules are removed from the rivet the compression spring biasing the upper cone washer towards the rivet head maintains the rivet in a substantially tight configuration.

7. The ring binder assembly of claim 6 wherein each eyelet further comprises:

an outer sleeve having an indentation;

an inner sleeve having an outwardly tapered edge and positioned within the outer sleeve; and the compression spring positioned within the outer and inner sleeves biasing the sleeves away from each other such that when the sleeves bias away from each other, the tapered edge engages the indentation preventing the two sections from separating from each other.

8. The ring binder assembly of claim 7, wherein the upper cone washer is integrally formed with the inner sleeve.

9. The ring binder assembly of claim 6 further comprising a lower cone washer positioned between the upper cone washer and the rivet head, wherein the modules engage the rivet between the upper and lower cone washers.

10. A ring binder assembly including a ring mechanism, a cover, and a pair of rivets secured in a substantially tight configuration through the cover and the ring mechanism, the assembly further comprising: a means to connect at least one removable module to the ring mechanism assembly between the ring mechanism and the cover; wherein the connecting means includes a pair of spool shaped washers each washer having a bore sized to receive one of the rivets.

11. The ring binder assembly of claim 10 further comprising:

a pair of eyelets positioned through the ring mechanism and separately against one of the washers, each eyelet having a bore sized to receive the pair of rivets.

12. The ring binder assembly of claim 11 wherein the eyelet and the washer are integrally formed into a unitary piece.

13. A ring binder assembly including a ring mechanism, a cover, and a pair of rivets secured in a substantially tight configuration through the cover and the ring mechanism, the assembly further comprising a means to connect at least one removable module to the ring mechanism assembly between the ring mechanism and the cover, which connecting means includes a first means secured to the rivets between the ring mechanism and the cover and having a removable attachment device; and a second means also having a removable attachment device configured to be removably attached to the first means and including a module.

* * * * *